US008678751B2

(12) United States Patent
Tibbott et al.

(10) Patent No.: US 8,678,751 B2
(45) Date of Patent: Mar. 25, 2014

(54) COOLING ARRANGEMENT

(75) Inventors: Ian Tibbott, Lichfield (GB); Ian W. R. Harrogate, Uttoxeter (GB)

(73) Assignee: Rolls-Royce PLC, London (GB)

( * ) Notice: Subject to any disclaimer, the term of this patent is extended or adjusted under 35 U.S.C. 154(b) by 597 days.

(21) Appl. No.: 12/461,814

(22) Filed: Aug. 25, 2009

(65) Prior Publication Data

US 2010/0119377 A1 May 13, 2010

(30) Foreign Application Priority Data

Nov. 12, 2008 (GB) ..... 0820624.5

(51) Int. Cl.
*F01D 5/00* (2006.01)

(52) U.S. Cl.
USPC ..... 415/115; 416/96 R; 416/97 R

(58) Field of Classification Search
USPC ..... 415/115; 416/95, 96 R, 97 R
See application file for complete search history.

(56) References Cited

U.S. PATENT DOCUMENTS

| | | | | |
|---|---|---|---|---|
| 4,992,025 | A * | 2/1991 | Stroud et al. | 416/97 R |
| 5,271,715 | A | 12/1993 | Zelesky et al. | |
| 5,403,158 | A | 4/1995 | Auxier | |
| 6,000,908 | A * | 12/1999 | Bunker | 416/95 |
| 6,997,675 | B2 * | 2/2006 | Dube et al. | 415/115 |
| 7,306,026 | B2 * | 12/2007 | Memmen | 164/516 |
| 7,563,072 | B1 * | 7/2009 | Liang | 416/96 A |
| 7,785,071 | B1 * | 8/2010 | Liang | 416/97 R |
| 7,789,626 | B1 * | 9/2010 | Liang | 416/97 R |
| 8,052,390 | B1 * | 11/2011 | Liang | 416/97 R |
| 2002/0127104 | A1 | 9/2002 | Beeck et al. | |
| 2005/0031452 | A1 | 2/2005 | Liang | |
| 2006/0083614 | A1 * | 4/2006 | Cunha et al. | 416/97 R |
| 2007/0140848 | A1 * | 6/2007 | Charbonneau et al. | 416/96 R |
| 2009/0185903 | A1 | 7/2009 | Beeck et al. | |

FOREIGN PATENT DOCUMENTS

| | | | | |
|---|---|---|---|---|
| AT | 404 160 | B | 9/1998 | |
| EP | 0 641 917 | A1 | 3/1995 | |
| EP | 1 013 877 BI | | 6/2000 | |
| EP | 1 790 821 | A1 | 5/2007 | |
| EP | 1 803 897 | A2 | 7/2007 | |
| EP | 1803897 | A2 * | 7/2007 | F01D 5/18 |
| EP | 1 847 684 | A1 | 10/2007 | |

* cited by examiner

*Primary Examiner* — Edward Look
*Assistant Examiner* — Liam McDowell
(74) *Attorney, Agent, or Firm* — Oliff PLC

(57) ABSTRACT

Within components such as high pressure turbine blades and aerofoils in a gas turbine engine it is important to provide cooling such that these components remain within acceptable operational parameters. Typically, film cooling as well as convective cooling is utilized. Film cooling requires holes from a feed passage from which the coolant is presented upon an external surface to develop the film. The holes themselves can create cooling through convective cooling effects. In order to maximize the convective cooling effect holes are created which have an indirect path about a direct line between an inlet and an outlet for the hole. By creating an indirect path in the form of a helix or spiral which in turn may have a variable cross sectional area from the inlet to the outlet control of coolant flow can be achieved. The inlet may have a bell mouth shape while the hole may have a slot or elliptical cross section to achieve greater diffusion of the coolant flow in order to create an improved exit blow rate for instant film development.

17 Claims, 6 Drawing Sheets

COOLING ARRANGEMENT

The present invention relates to cooling arrangements and more particularly to cooling arrangements utilised in gas turbine engine components such as aerofoils.

It will be understood that the performance of a gas turbine engine cycle, whether measured in terms of efficiency or specific output, is improved by increasing the turbine gas temperature. It is desirable to operate the turbine at as high a temperature as possible. For any engine cycle compression ratio or bypass ratio, increasing the turbine entry gas temperature will always produce more specific thrust, that is to say engine thrust per unit air mass flow. However, as turbine entry temperatures increase, the life of an uncooled turbine or other components falls, necessitating the development of better materials and the introduction of internal air cooling.

With regard to a gas turbine engine, the high pressure (HP) turbine and gas temperatures are now generally much hotter than the actual capability of the materials from which certain components such as aerofoils are formed. In such circumstances, it is necessary to provide cooling for such components. Furthermore, cooling of intermediate and low pressure turbines may also be required. During passage through a turbine the mean temperature of the gas stream decreases as power is extracted. The need to cool static and rotary parts of the engine structure decreases as the engine moves from the high pressure stages through the intermediate and low pressure stages towards the exit nozzle.

Internal convection and external films are the principal ways of cooling components such as aerofoils. High pressure turbine nozzle guide vanes (NGVS) generally consume the greatest amount of cooling air whilst high pressure turbine blades themselves typically utilise half of the cooling flow for a nozzle guide vane. Intermediate and low pressure stages use progressively less cooling air.

FIG. 1 provides a front perspective view of a turbine engine arrangement with regard to the high pressure stages. It will be noted that a support casing (1) presents an outer platform (2) and a shroud segment (9). The platform (2) presents one side of an aerofoil (4) with the opposite side presented upon an inner platform (3) and also presents a nozzle guide vane (5). The shroud segment (9) is opposed by a shroud (8) at one end of an aerofoil (6) which projects from a platform (7) associated with a high pressure turbine rotor blade (14) presented upon a disc (13). It will be understood that hot gas (10) passes over the aerofoils (4), (6) whilst cooling flows (11) pass through an array of vanes (12) in order to cool the aerofoils (4), (6) appropriately. Generally, the aerofoils (4), (6) include outlets from holes which extend from feed passages within the interior parts of the aerofoils (4), (6). In such circumstances, as described above generally high gas temperatures flows (10) can be accommodated by appropriate cooling of the components such as aerofoils (4), (6) through the cooling flows. The principal processes for cooling are convective cooling and film cooling as described above.

In a gas turbine engine and in particular the high pressure turbine nozzle guide vanes and rotor blade aerofoils cooling is principally through internal convective cooling along feed passages and external film cooling. There is also convective cooling in the hole between the feed passage and the outlet to define the external film cooling. Generally, the internal cooling comprises convective cooling as the coolant passes along the hole to the exterior outlet for film cooling. It will be understood that the film cooling creates a protective blanket of relatively cool air on the external surface of the component for protection.

Generally, the convective cooling element towards the external surface of the component associated with the film cooling holes contributes in the area of 10-15% of the total convective cooling effect. This is a relatively small proportion but nonetheless is important in terms of contribution to the overall cooling effect. The level of cooling is dependent upon and proportional to the overall length of the cooling holes. At a leading edge location typically the holes are configured at a steep angle of 50 to 65 degrees measured towards a perpendicular projected from the surface in a radial direction. Such angle creates a maximum length for the holes which increases their wetted and therefore cooled surface area within the hole. However, these steeply angled holes are not optimised for film cooling development. Consequently, film cooling holes located on the pressure surface and the suction surface of a component such as an aerofoil tend to be configured at less steep angles. The holes are also drilled generally perpendicular to the overall surface and relative to a radial direction. In such circumstances, the lengths of the holes to the external surface are relatively short and therefore the convective cooling effect limited. In such circumstances generally a compromise is required between the desired creation of film cooling effects and convective cooling effects in the holes to the outlets for that film cooling effect.

Generally, cooling holes for film development are manufactured or provided by drilling using a laser or an electro-discharge machine (EDM). These processes typically produce straight circular cross-section holes over the majority of the holes length. In such circumstances once again, the convective cooling effect associated with these holes is only felt locally at the centre of the holes and the effected area is small. In order to extend the effective area more cooling holes are necessary and this increases the combined volume of coolant and coolant mass flow required for operational purposes.

A further limitation with regard to the straight line nature of the drilling process is that it adversely affects the cooling effectiveness. The steeper the angle the holes are drilled to the hot gas gaswashed surface of the component, the lower the local film cooling performance. Laser drilled holes and EDM drilled holes have to be machined at angles which cannot be less than 25 degrees to the wash angle on the external surface. If a more acute angle is used the laser beam or EDM process becomes less focused and effectively bounces off the surface with a blurred if any drilling effect.

In view of the above, the manner of producing film cooling holes is not optimised with regard to achieving a desired length and shape of the holes and this limits both convective and film cooling performance.

FIG. 2 provides a cross section of a typical component in the form of an aerofoil and its leading edge (20). As can be seen, a feed passage (21) for a coolant flow (22) extends along the length of the component and in particular the leading edge (20). Holes (23) extend from the passage (21). These holes (23) in the prior arrangement as depicted in FIG. 2 are generally straight. Thus, the walls (25) of the holes (23) are limited in their potential convective cooling effectiveness. It is also appreciated that the angle of the holes (23) through which the cooling flows (26) are projected may not be optimised with regard to developing film cooling.

In the cross section depicted in FIG. 2 it will be noted that the component is generally hollow in order to define the passage (21). In such circumstances, there is a thickness in the component through which the holes (23) project. With circular holes (23) it is understood that the effective cooling area is limited and therefore as indicated above, a balance has to be struck between the effectiveness of film cooling at the external surface (24) and the convective cooling effect with regard to materials in the walls of the component (20).

In accordance with aspects of the present invention, there is provided a cooling arrangement for a gas turbine engine, the arrangement comprises a component having a passage within the component with a hole to an external surface of the component, the hole defining an indirect flow path generally between the passage and the surface radially, generally along a direct line between the hole and an outlet upon the surface.

Generally, the indirect flow path is a helix orientated about an axis that is substantially perpendicular to the thickness of the wall of the aerofoil component. Possibly the helix is a double helix. Generally, the indirect flow path extends along the direct line between the hole and the outlet. Typically, the direct line may be angled to a perpendicular projected radially from the external surface.

Generally, the hole has a pigtail cross section.

Typically, the hole is configured at the outlet to project a fluid upon the external surface. Typically, the projection is to develop film cooling upon the external surface.

Typically, the hole has a variable cross sectional area between the passage and the outlet. Possibly, the hole tapers in cross section from one end to the other.

Generally, the inlet to the hole from the passage has a bell end cross section.

Possibly, the flow path at least in part is defined by the shape of the hole.

Typically, the flow path at least in part is defined by surface features of the hole.

Possibly, the hole is angled at the outlet.

Generally, the component is an aerofoil and in particular an aerofoil utilised in a rotor or a guide vane in a gas turbine engine.

Generally, the passages are feed passages for coolant through the component.

Typically, the outlet is arranged to develop a surface film upon the external surface about the hole.

Possibly, in accordance with aspects of the present invention the hole has an elliptical or slot cross section. Possibly, the exit to the hole has a slot or elliptical cross section.

Generally, the indirect path will be centred upon the direct line to create a clockwise or anticlockwise pathway from the inlet to the outlet.

Possibly, the hole incorporates branches between the inlet to a plurality of outlets.

Aspects of the present invention will now be described by way of example and reference to the accompanying drawings in which:—

FIG. 1 provides a front perspective view of a turbine engine arrangement with regard to the high pressure stages.

FIG. 2 provides a cross section of a typical component in the form of an aerofoil and its leading edge.

Figure 1:
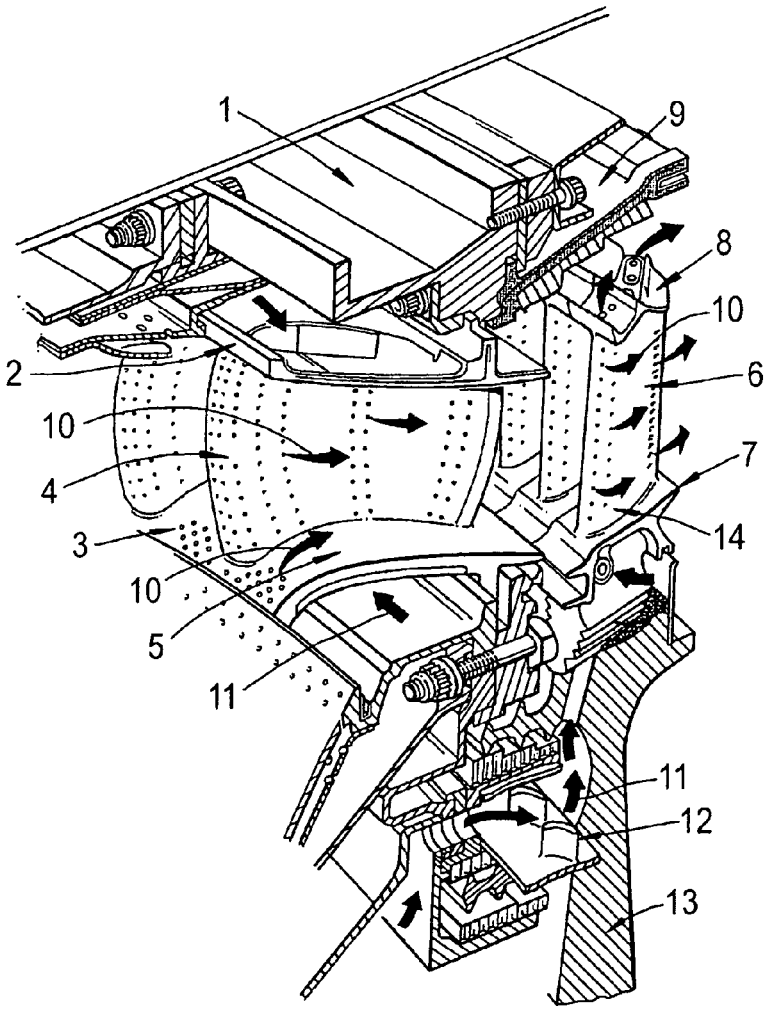
Fig.1 PRIOR ART
Figure 2:
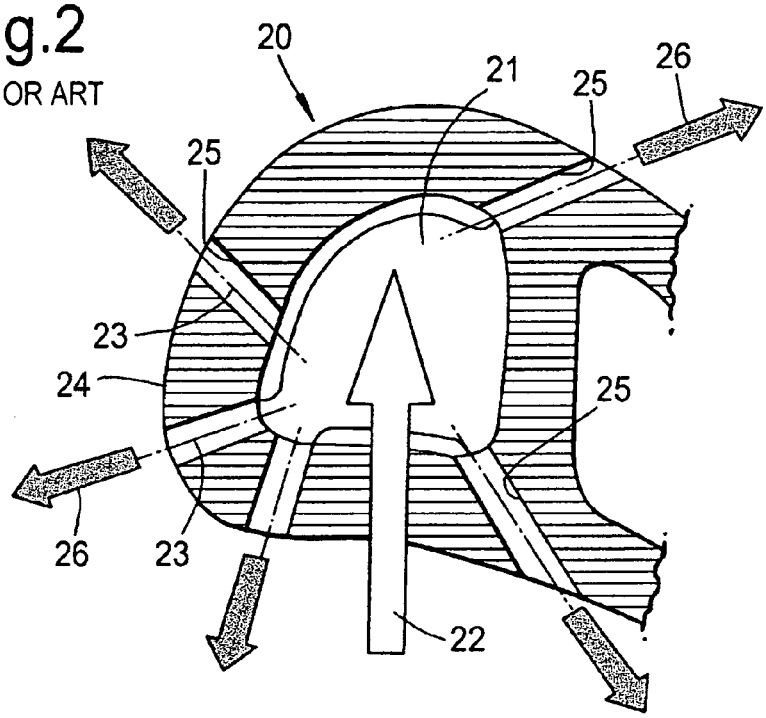
Fig.2 PRIOR ART

As illustrated above, typical prior holes utilised for surface film cooling effects on a component such as an aerofoil in a gas turbine engine have had a number of problems and disadvantages. These problems include a limited length for the hole and therefore a limited convective cooling potential. It is also understood that the angle of the hole may not be ideal and therefore the film cooling effect limited particularly at the leading edge. Such problems with regard to the film cooling effect may adversely affect the turbine in terms of its operational life and performance. The inlet pressure loss may also be higher than desired due to the recast layer at the entrance to the hole which is typically as indicated above produced by a laser or a electro-discharge machining process. It will also be understood that there is a limit to exit expansion for the hole upon the external surface and associated shape constrictions may result in limitations with regard to the diffusion angle for the film upon the external surface. There is also a lack of control with regard to internal flow velocity distribution along the length of the hole due to such limitations and generally constant cross sectional area with traditional hole drilling techniques (laser or EDM). The internal heat transfer coefficients are dictated by entrance effects and hole diameter and are not ideal. Holes have to be drilled with a substantially constant diameter over the majority of the hole length and this limits designer choice with regard to internal coolant flow velocity and flow distribution within the hole in order to create better convective cooling effects. Long, straight holes suffer from a thicker boundary layer on the internal surface of the hole which reduces internal heat transfer coefficients and cooling effectiveness at the end of the holes.

In view of the above, it will be understood that prior arrangements are not ideal with regard to achieving adequate cooling for components such as aerofoils, in nozzle guide vanes or rotors of a gas turbine engine. It will be understood that small improvements in cooling effectiveness may provide significant benefits with regard to enabling the engine to operate at a higher temperature and therefore achieve greater overall efficiency.

Recent advances with regard to manufacturing techniques allow improvements in creation of internal flow path shapes within structures such as aerofoil components. Prior arrangements typically utilised lost wax or other techniques in order to create internal flow paths. These traditional techniques involved injecting a liquid ceramic under pressure into a mould/die and injecting wax over the ceramic core within the wax mould/die, and then coating the wax form with a ceramic coating and subsequently melting the wax out. The wax would then be removed to leave a core as an appropriate mould with internal passages for cooling flow paths.

More recent techniques created internal core and cooling holes on outer aerofoil shapes in a one piece process by solidifying or sintering a liquid ceramic material with a laser beam, layer by layer, until the whole blade assembly is produced ready to pour in molten metal by a casting process. By such processes, cooling passages and in particular cooling holes can be configured in almost any shape, without the need for a ceramic or wax mould/die with positive draft angles to aid core or wax removal etc or even the need to drill cooling holes into the metal of the component. With such manufacturing techniques configurations are now possible which in the past could not be made and such configurations even allow re-entrant features to be created within components such as aerofoils.

By aspects of the present invention, film cooling holes can be created which have a small spiral passage which is shaped in order to give a hole which is longer and therefore has a greater potential for convective cooling. The hole will typically have a spiral or pigtail cross section with the cross sectional area changing along its length in order to optimise both the convective and film cooling effectiveness of the hole upon and within a component.

The holes will be configured with typically a bell mouth shape at the entrance to a feed passage to reduce entrance losses in the cooling process and to accelerate the coolant flow in the hole in order to direct it through a tight spiral or helix passage to an outlet for presentation of the coolant in a film cooling configuration upon the external surface. The spiral portion will allow a designer to provide effectively longer hole lengths within the wall of the component between the feed passage and the external surface. The coolant flow within the hole and in particular the spiral or helix bends will be forced by centrifugal forces onto the outer surface of the bend which will effectively reduce the thickness of the boundary layer of the flow inside the hole and locally increase the heat transfer coefficient where most beneficial, that is to say within the hole and therefore improve the cooling of the component. In short, the gas washed surface of the component and in particular the available surface area of the hole between the passage and the external surface will be increased.

By having a complete revolution spiral or helix in a pigtail format for the hole it will be understood that coolant flow decelerates in an expanded region of the hole and emerges onto the external surface of the component as a diffused layer of film cooling air. The slower moving coolant film flow will reduce the film blowing rate and therefore provide an optimum film cooling performance. It will be understood that the film blowing rate (BR) is given by the following expression:—

$$BR = \frac{(\text{Density} \times \text{Exit Velocity})\ \text{coolant}}{(\text{Density} \times \text{Surface Velocity})\ \text{gas}}$$

In accordance with aspects of the present invention, essentially a hole is now defined which extends from the feed passage for coolant to an external surface of the component. The hole defines an indirect flow path between the passage and the external surface about a direct line between the hole and the outlet upon the external surface. Generally, the holes extend radially about and circle the direct line. The direct line defines a typical prior straight line drilled hole. By providing a hole which is indirect, that is to say is in a helix or spiral or otherwise twisted it will be understood that an increase in hole length is achieved as well as potential convective cooling effects through shaping of the hole. As indicated, typically the indirect path comprises a helix or spiral or twist that turns about an axis that is substantially perpendicular to the thickness of the wall of the component, which extends generally along a direct line from the inlet to the outlet. It may also be possible to define this direct line itself as a bow or curve upon which the indirect path is centred again to increase the effective length of the hole in the component. The nominal direct line is generally lateral rather than longitudinal along the compartment.

Figure 3:
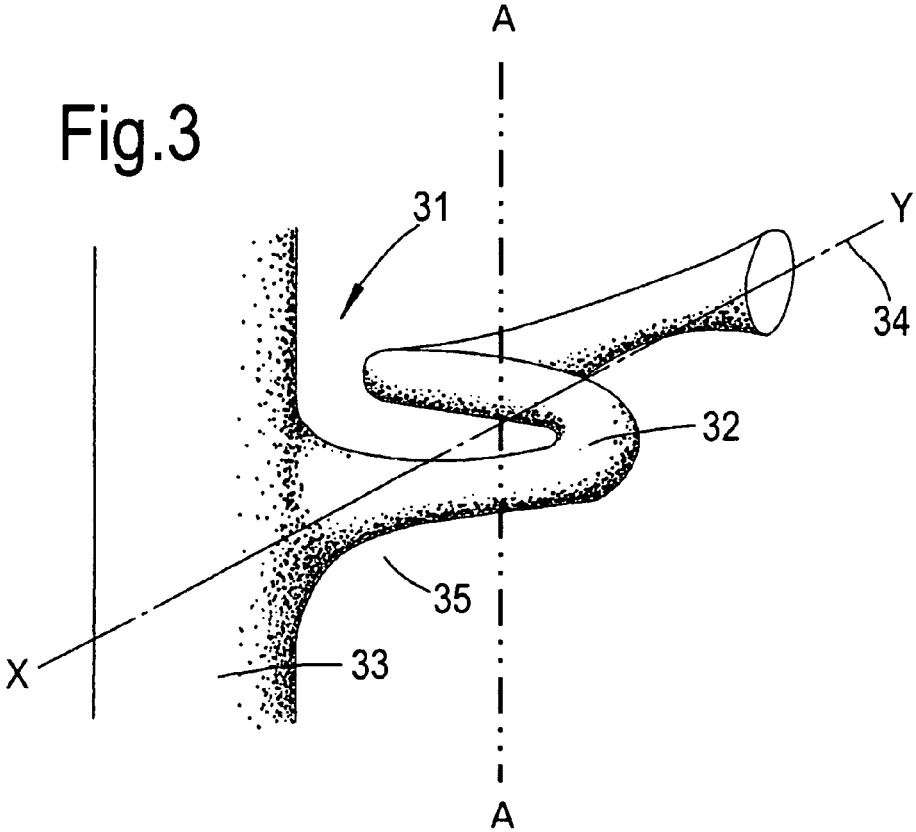
FIG. 3 is a pictorial illustration of a first embodiment of a cooling arrangement in accordance with aspects of the present invention.

FIG. 3 provides a pictorial illustration of a first embodiment of a cooling arrangement in accordance with aspects of the present invention. The cooling arrangement (31) has a smooth walled single helix hole (32) between a feed passage (33) and an outlet (34). It will be appreciated the pictorial depiction is effectively a negative and the depiction is of the passage with its surrounding component structure removed. It will be noted that the hole (32) as indicated extends in a helix that turns about an axis A-A, which is substantially perpendicular to the thickness of the wall of the component, and extends substantially along a direct line X-Y between an entrance inlet (35) from the feed passage (33) to the hole (32) and to the outlet (34). The inlet (35) is generally bell mouthed in order to define further effects as indicated above with regard to cooling effectiveness through the hole (32). Generally, the outlet (34) will be slot shaped to provide a diffused exit to improve coolant film development and avoid dirt blockage upon an external surface of the component. It will be understood that by providing the helix or indirect flow path between the inlet (35) and the outlet (34) an increase in overall effective length in comparison with a direct line X-Y hole between those points is provided. This increase in effective length in its own right will increase convective cooling effects but also bends in the helix of the path 32 as indicated above through speeding and slowing will also increase wash impingement upon the surfaces of the hole (32) and therefore cooling effectiveness.

Figure 4:
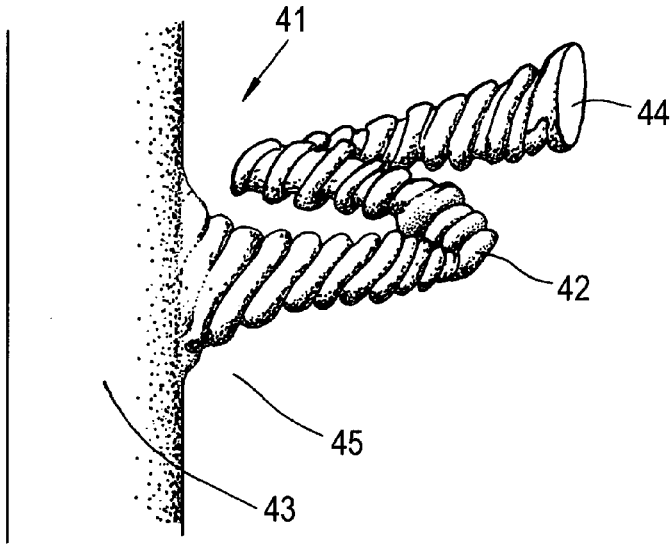
FIG. 4 is a pictorial depiction of a second embodiment of a cooling arrangement in accordance with aspects of the present invention.

FIG. 4 provides an illustration of a second cooling arrangement (41) in accordance with aspects of the present invention. Again, the depiction is pictorial and is a negative of the passage which in practice will be surrounded by the component structure. The second embodiment as depicted in FIG. 4 is of a so called double helix pigtail cross section. The first helix as described above with regard to FIG. 3 is generally created by the shape of a hole (42) which extends from an inlet (45) to an outlet (44). As previously the inlet (45) has a bell mouth cross section and is associated with a radial coolant feed passage (43). The outlet (44) will be associated with an external surface of a component in accordance with aspects of the present invention for film cooling effects. Again, the outlet (44) will generally have a slot shape to provide a diffused exit for improved cooling film development as well as to avoid dirt blockage and resistance in use.

In the second embodiment as depicted in FIG. 4, a second helix is created by surface features and contouring within the wall of the hole (42). The surface features create the second helix as a rifling surface finish within the hole (42) which resembles an internal thread. It will be understood that this second helix will cause the cooling flow through the hole to swirl around the periphery of the hole as it progresses along the length of the hole from the inlet (45) to the outlet (44). This swirling flow in the double helix created by the hole shape as well as the surface contouring will create a higher velocity than the single helix as depicted in FIG. 3 which in turn should increase internal heat transfer coefficients and therefore cooling effectiveness.

Figure 5:
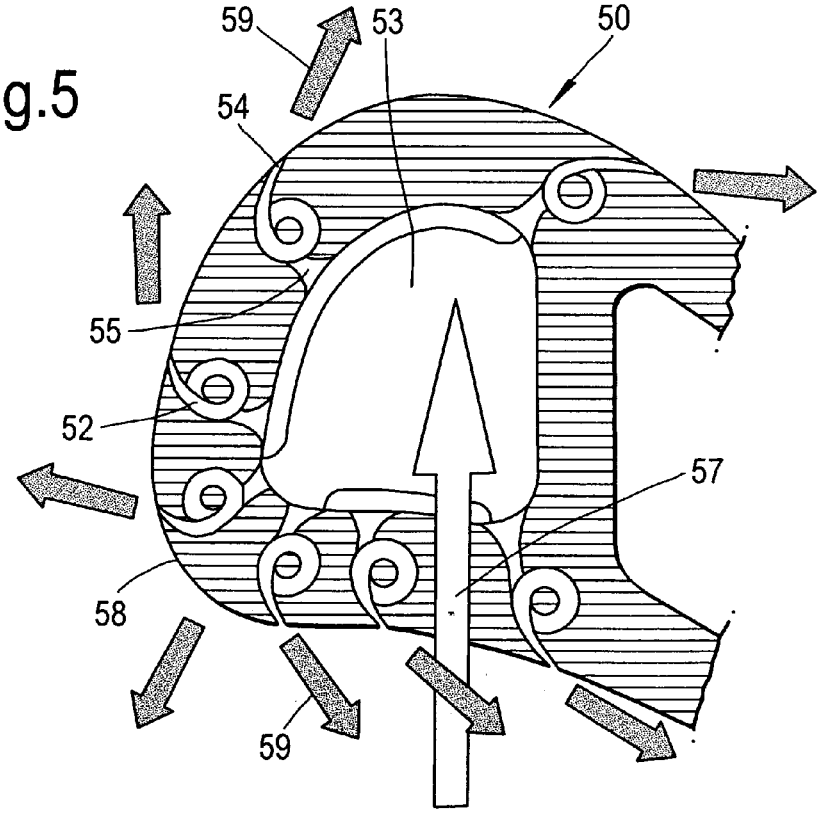
FIG. 5 is a cross section of a component in the form of a leading edge for an aerofoil incorporating a cooling arrangement in accordance with the first embodiment as depicted above with regard to FIG. 3.

FIG. 5 provides a cross section of a component (50) in the form of a leading edge for an aerofoil. The component (50) includes a number of cooling arrangements in accordance with the first aspects of the present invention as depicted in FIG. 3. In such circumstances as can be seen, an internal feed passage (53) has a coolant flow (57) which is fed through the cooling arrangements in accordance with aspects of the present invention. These cooling arrangements comprise inlets (55) and outlets (54) to an external surface (58). Between the inlets (55) and outlets (54) a hole (52) is created with an indirect path as described above. This indirect path again is a spiral or a helix which extends radially either side and about a direct line. In such circumstances, it will be understood that the coolant flow (57) is distributed through the cooling arrangements via the inlets (55) through the holes (52) to the outlets (54) in order to develop through projected coolant flows (59) coolant films upon the external surface (58).

Figure 6:
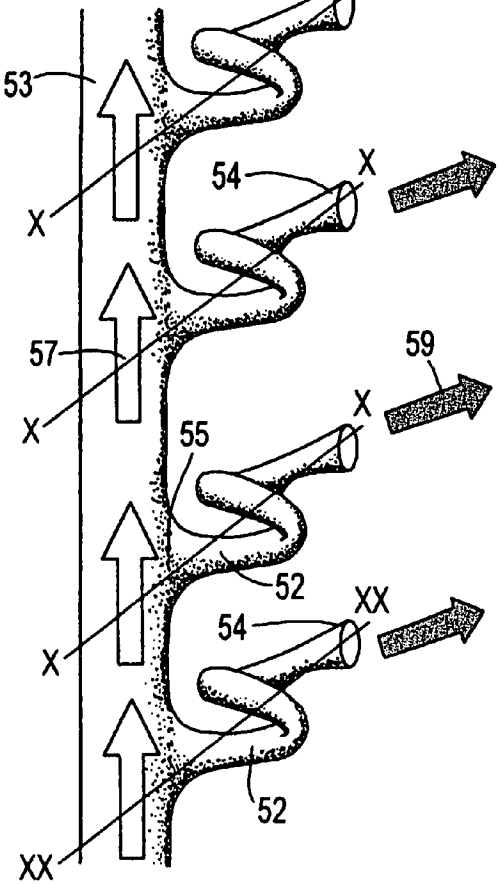
FIG. 6 is a pictorial depiction along a section of a feed passage in accordance with aspects of the present invention.

The number of cooling arrangements in accordance with aspects of the present invention in a component and their position will depend upon the necessary creation of film cooling effects upon the external surface (58) as well as achieving convective cooling within the wall thickness of the component (50) between the passage (53) and the external surface (58). In such circumstances as depicted in FIG. 6 generally, a number of cooling arrangements in accordance with aspects of the present invention will be positioned axially or longitudinally along the length of the passage (53). In such circumstances, the current flows (59) projected through the outlet exits (54) will act upon proportions of the external surface (not shown in FIG. 6). As previously generally the outlets (54) will have a slot shape to provide dispersion for the flow (59) in order to create the film cooling as well as avoid dirt blocking such exits (54) in use.

The holes (52) have an indirect path which again is of a helix nature, the helix turning about an axis A-A, and extending generally along a direct line X-X. The direct lines X-X for each hole (52) may as illustrated in FIG. 6 be all consistent in terms of angle relative to the perpendicular or horizontal of the passage (53). Alternatively, different angles may be created at different levels for each hole (52). Furthermore, as illustrated with regard to direct line XX-XX a slight bend for this line can be created in order to again alter the orientation of the hole (52) and therefore adjust its effectiveness in terms of convective cooling as well as projection of the cooling upon the external surface (not shown).

As indicated above, the exits (54) will generally be in the form of a slot which is shaped to be tangential to the gas washed surface, that is to say the external surface of the component. The film cooling will be attracted or forced onto the aerofoil surface due to the Coanda effect. The Coanda effect creates an effective attachment of the film to the surface and therefore provides as indicated above a protective coolant layer.

Although not illustrated there is an optional row of cooling arrangements in accordance with aspects of the present invention which passes directly through the leading edge stagnation point of a component such as an aerofoil. This may have benefits again with regard to creating cooling effects within an aerofoil which would be beneficial with regard to gas turbine operation.

Figure 7:
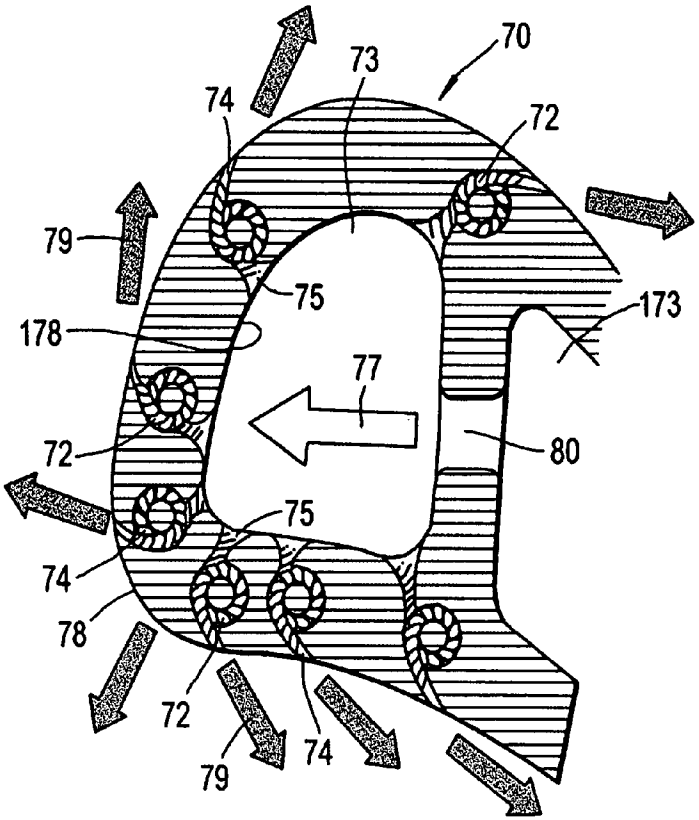
FIG. 7 is a cross section of a leading edge of an aerofoil component incorporating a cooling arrangement in accordance with second embodiments of aspects of the present invention as depicted in FIG. 4.
Figure 8:
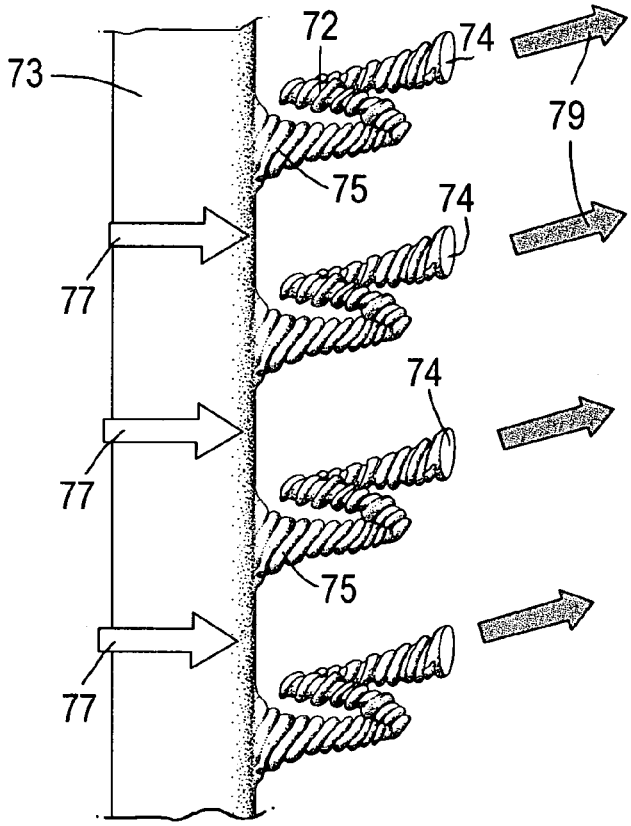
FIG. 8 is a pictorial depiction of a feed passage as depicted in FIG. 7.

FIG. 7 and FIG. 8 respectively show cooling arrangements in accordance with second embodiments of aspects of the present invention as depicted in FIG. 4 in a component such as a leading edge of an aerofoil. The component (70) has a number of such cooling arrangements positioned in all surfaces of the component. The cooling arrangements as indicated above, are of a double helix type in which the shape of the holes (72) as well as surface features within those holes create respective indirect paths along and about direct lines between the inlets (75) and outlets (74). It will be appreciated that the second helix as indicated above is created by surface features within the hole (72). These features effectively create a screw thread or rifling within the holes. The screw thread or rifling may be clockwise or anti-clockwise dependent upon requirements for coolant swirl. The effectiveness of the indirect path in the form of a helix or swirl or spiral as well as the surface features will be to create enhanced flow and therefore convective cooling effects within the holes in accordance with aspects of the present invention. As indicated above generally, the shape of the hole will be along and centred upon a direct line between the inlet and the outlet. This direct line may be a straight line or bowed or curved or even itself slightly spiraled in order to create further effects with regard to the pathways created between the inlets (75) and the outlets (74).

It is understood that as previously described with regard to the first embodiment of a cooling arrangement in accordance with aspects of the present invention as depicted in FIG. 3 and FIGS. 5 and 6, the number and distribution of cooling arrangements may vary depending upon requirements. Generally, as illustrated in FIG. 8, a number of cooling arrangements will be positioned along the length of the feed passage (73). The angle of the holes (72) may be the same for each hole along the length of the passage (73) or different. Furthermore, the number and distribution of surface features within the holes in terms of the screw thread or rifling may vary between the holes (72) dependent on requirements in order to achieve the desired enhanced convective cooling effects as well as creation of surface films. The outlets (74) as described previously will generally be of a slot nature in order to achieve diffusion and therefore film generation upon the external surface (not shown) as well as avoid debris blockage.

It is understood that by the holes between the inlets (75) and outlets (74), coolant flow (79) is presented upon an external surface (78) of the component (70) in order to create a film cooling effect whilst the coolant flow in passing through the holes (72) will create convective coolant within the wall portions of the component (70). In the embodiments depicted in FIG. 7, the coolant flow (77) within the feed passage (73) is presented through an impingement aperture (80). Thus, a separate feed passage (173) may be created within the bulk of the component (70) and therefore compartmentalisation of the passages (73) about the leading edge achieved for enhanced cooling effects. It will be understood that by providing an impingement fluid flow (77) this flow is directed towards an inner surface (178) of the component (70) and therefore may have a more perpendicular aspect and so a greater cooling effect upon that surface (178).

Figure 9:
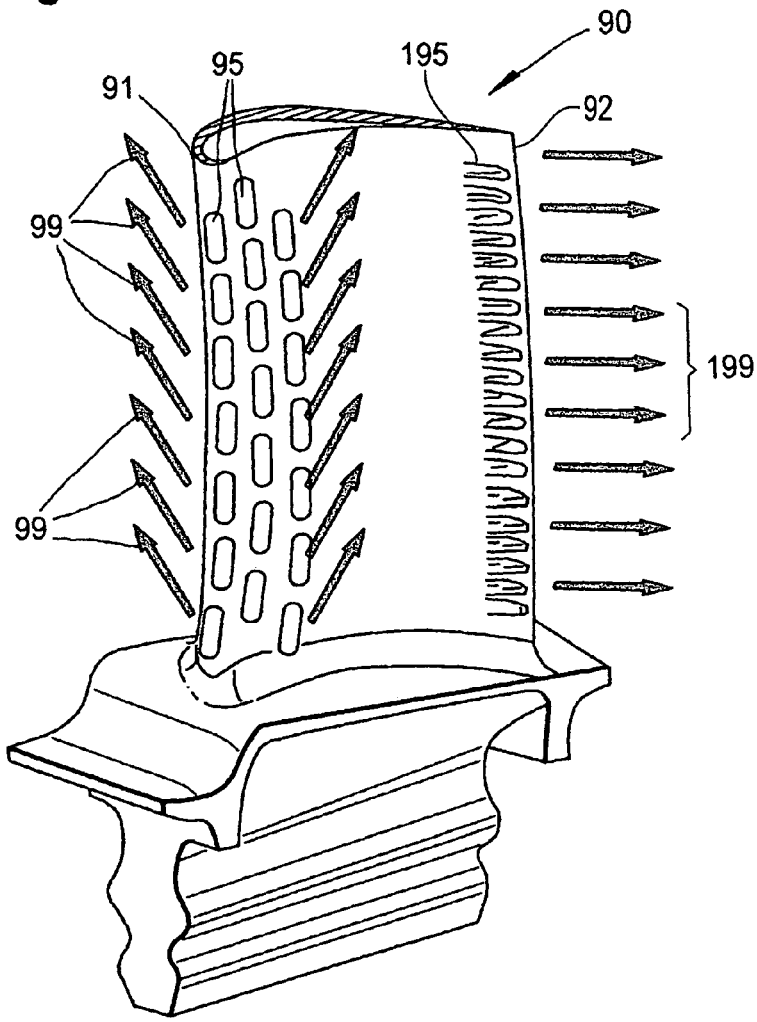
FIG. 9 is a pictorial perspective view of an aerofoil rotor incorporating a cooling arrangement in accordance with aspects of the present invention; and, FIG. 10 is a pictorial cross section of a leading edge of an aerofoil component incorporating a wall thickness increased to accommodate a cooling arrangement in accordance with aspects of the present invention.

FIG. 9 provides a perspective view of an aerofoil (91) as a component in accordance with aspects of the present invention. Along a leading edge of the aerofoil (90), outlets (95) are provided in the form of slots which create and present external flows (99) in order to create film cooling upon the surfaces of the component (90). Towards a trailing edge (92) of the component (90) coolant flows (199) will be projected for effects upon adjacent aerofoils. In the perspective view depicted in FIG. 9, it is understood that the external surfaces with the cooling holes (95) and cooling holes (195) will achieve overall film coverage upon the aerofoil (91) and parts of the adjacent aerofoil for better utilisation of the coolant flows in use.

Figure 10:
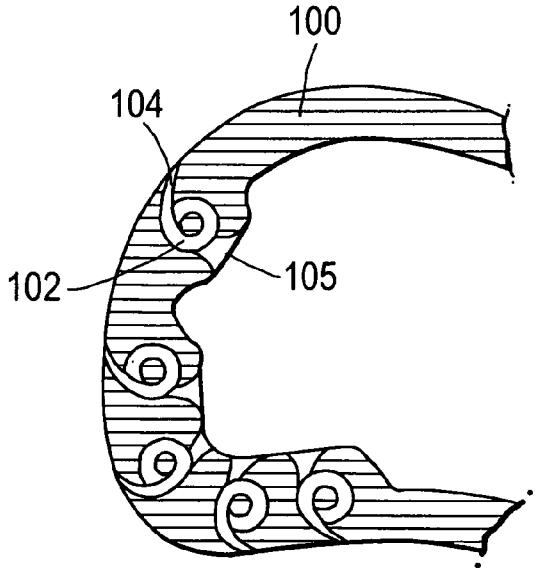

FIG. 10 provides a plan cross section of the leading edge of an aerofoil as a component (100) incorporating cooling arrangements in accordance with aspects of the present invention. The cooling arrangements include inlets (105) and outlets (104) with a hole (102) there between. The hole (102) is of an indirect nature and as illustrated previously generally has either a single spiral or double spiral configuration about, that is to say either side of a direct line between the inlet (105)

and the outlet (104). In such circumstances a greater effective hole length is created for improved convective cooling effects.

In order to accommodate a cooling arrangement in accordance with aspects of the present invention it would be appreciated that the cross section of the aerofoil (100) wall is thickened. In such circumstances it is understood that an even greater length for the hole (102) can be created for improved cooling effects.

The holes in accordance with aspects of the present invention typically take a so called pigtail configuration. It will be appreciated that pigtails have a spiral relationship between one end and the other. Generally, the inlets (105) in accordance with aspects of the present invention are of a bell mouth or expanded nature in order to concentrate and regulate coolant flow along the hole in accordance with aspects of the present invention.

Convective cooling enhancement with respect to holes utilised generally for film cooling effects in components such as aerofoils and gas turbine engines are of principal concern with regard to aspects of the present invention. In order to enhance convective cooling effects, as indicated above, generally the cross sectional area of the hole will vary from one end to the other. Typically, one end, for example the inlet (105) will have a bell mouth and therefore a wide cross section whilst the outlet will have a slot shape for presentation of the exiting coolant flow in order to develop a film upon an external surface. Between the inlet and the outlet, variations in the cross sectional area of the hole can be achieved. These variations may relate to creation of surface features upon the hole in order, as indicated above, to develop a second helix or otherwise create flow movements with regard to the coolant flow in the hole in accordance with aspects of the present invention. Generally, the variations will taper from one end to the other end of the hole in accordance with aspects of the present invention. Furthermore, there may be constriction and expansion with regard to the cross sectional area of the hole in accordance with aspects of the present invention in order to create enhanced convective cooling effects as described above.

By aspects of the present invention, enhanced cooling effects are achieved. This enhancement relates to provision of longer film cooling holes through walls of a component such as an aerofoil in a gas turbine engine. Longer cooling holes will improve convective heat transfer and therefore cooling efficiency.

High levels of internal heat transfer onto surfaces of the hole in the form of a pigtail may be achieved through creation of centrifugal forces locally within the hole. The centrifugal forces will thin the boundary layer and therefore enhance cooling effectiveness within and upon engagement by the coolant flow upon surfaces of the hole.

By enabling improved film cooling hole exit angles, that is to say more tangential to the gas washed surface, it is possible to provide a better film cooling effectiveness in terms of coverage.

Film cooling in accordance with aspects of the present invention will also take advantage of the Coanda effect with respect to overflows by gas flows with regard to such components as aerofoils in a gas turbine engine.

By utilisation of bell mouth entrances to the inlets for the holes in accordance with aspects of the present invention, there will be a reduction in entry losses for the coolant flow into the holes and therefore improvements in cooling effectiveness.

Controlled hole shape in terms of variations in the cross sectional area of the hole between the inlet and the outlet will allow local acceleration and/or deceleration with regard to coolant flow along the hole and therefore enhancement with respect to development of film cooling in terms of the achieved blow rate, and other factors at the external surface of the component. It is possible to achieve higher internal heat transfer coefficients over longer lengths of the hole by creation of the indirect, typically helix and possibly double helix path for the hole in accordance with aspects of the present invention. By utilisation of a slot shaped exit geometry it is possible to further create improved film development through holes on the surface of a component in accordance with aspects of the present invention. By having a slot shaped exit, it is understood that greater resistance to debris, blockage and other factors can be achieved. Provision of slot shaped exit geometries is possible by utilisation as indicated above of more modern forming techniques with regard to manufacture. It will be appreciated it is difficult to create slot shaped exits with traditional laser or EDM type drilling processes.

Creation of rifling or double helix spirals through surface features within the holes in accordance with aspects of the present invention will increase local surface velocity and residential time of the coolant flow which in turn will increase internal heat transfer coefficients and therefore cooling performance.

It may be possible to reduce the number of cooling holes required by a component by incorporating a cooling arrangement in accordance with aspects of the present invention in comparison with prior conventional straight drilled cooling arrangements.

By improving the cooling efficiency it is understood that the amount of coolant mass and volume required will be reduced therefore enhancing overall engine performance. By more judicious use of coolant flows it is understood that there will be a reduction in the aerodynamic mixing losses and therefore improvements in overall performance of a component in accordance with aspects of the present invention.

As indicated above, cooling arrangements in accordance with aspects of the present invention will typically be utilised with regard to a gas turbine engine. The cooling arrangements can be utilised to cool high pressure turbine nozzle guide vane aerofoils, platforms and shroud segment liners as well as rotor blade components as described with regard to the embodiments above.

As indicated above, in addition to the creation of indirect paths which may be single or double helix along a direct line between the inlets and the outlets, it is understood that by manufacturing processes it is possible to shape the holes to have an elliptical or race track or lozenge shape along their length or provide a combination of round, elliptical and race track lozenge slot shapes along the length again to control coolant flows and improve effective cooling efficiency.

The cross sectional area of the holes as indicated above may vary along the length of the hole so allowing acceleration and deceleration with regard to the cooling flow and therefore improve cooling efficiency.

In terms of indirect shaping, it is understood that this shaping may create a clockwise or anticlockwise displacement relative to the direct path and this may be adjusted with respect to adjacent arrangements in a component in order to improve efficiency.

The aerofoil component will typically have a wall thickness which may be locally thickened in order to accommodate the holes and in particular the indirect pathway and again this may maximise or increase the length of the hole and therefore convective cooling efficiency.

Typically, by creating rifling or helix internal shaping to the wall or other internal features within the wall it is understood that further swirling in terms of direction and progress with a coolant flow along the hole can be adjusted.

Holes in accordance with the present invention may be branched into two or more exit holes with a single inlet hole again to increase wetted area and therefore convective cooling efficiency.

By provision of the helix or spiral indirect pathways through appropriate configuration radially extending outwardly from the inlet to the outlet it is understood that an appropriate cooling flow arrangement for any particular component requirement may be achieved.

Gas turbine engines in which the component in accordance with aspects of the present invention may be utilised in civil, military, marine and industrial turbine applications.

Generally, it will be understood that the holes in accordance with aspects of the present invention will extend substantially laterally with regard to the components. By laterally it is meant that the components will extend at a relatively high angle between the feed passage and the external surface in terms of the direct path but through provision of the indirect path and the spiral or helix format there about it will be understood that the angle at which the outlet parts of the hole to the exit are presented will be beneficial with regard to presenting the coolant flows for film development.

Modifications and alterations to aspects of the present invention will be appreciated by those skilled in the technology. Thus, for example the indirect path may be irregular in terms of the helix or spiral or other shaping in order to create localised flow advantages in terms of creation of the surface film for cooling effects as well as convective cooling. In such circumstances there may be straight sections or the spiral may have a conical path part in order to adjust the flow path length and angling of the coolant flow at the exit for coolant film development. Additionally, the cooling passage may branch between the inlet and a plurality of outlets.

The invention claimed is:

1. A component for a gas turbine engine, the component having a wall defining an internal surface, an external surface and a cooling passage, the cooling passage having an inlet defined in the internal surface, and an outlet defined in the external surface, the cooling passage defining a helix arranged to flow cooling air from the inlet towards the external surface, then to turn the cooling air towards the internal surface, before turning the cooling air back towards the external surface and through the outlet, wherein an axis of the helix defines the curvature and torsion of the helix, and the axis is substantially perpendicular to a thickness of the wall, the inlet to the hole from the cooling passage has a bell end cross section, and the outlet is in the form of a slot arranged to develop a surface film upon the external surface.

2. The component of claim 1, wherein the helix is a double helix.

3. The component of claim 1, wherein the cooling passage extends generally along a direct line between the inlet and the outlet.

4. The component of claim 1, wherein the direct line is angled to a perpendicular projected radially from the external surface.

5. The component of claim 1, wherein the cooling passage has a pigtail cross section.

6. The component of claim 1, wherein the cooling passage is configured at the outlet to project a fluid upon the external surface.

7. The component of claim 6, wherein the outlet is arranged to project the fluid to develop film cooling upon the external surface.

8. The component of claim 1, wherein the cooling passage has a variable cross sectional area between the inlet and the outlet.

9. The component of claim 8, wherein the cooling passage tapers in cross section between the inlet and the outlet.

10. The component of claim 1, wherein a cooling air flow path at least in part is defined by a shape of the cooling passage.

11. The component of claim 1, wherein a cooling flow path at least in part is defined by surface features of a wall of the cooling passage.

12. The component of claim 1, wherein the cooling passage is angled at the outlet.

13. The component of claim 1, wherein the component is an aerofoil utilised in a rotor or a guide vane in a gas turbine engine.

14. The component of claim 1, wherein the cooling passage is a feed passage for coolant through the component.

15. The component of claim 1, wherein the cooling passage has one of an elliptical cross section and a slot cross section.

16. The component of claim 1, wherein the cooling passage creates one of a clockwise and a counterclockwise pathway from the inlet to the outlet.

17. A plurality of cooling arrangements comprising the component of claim 1.

* * * * *